US005224878A

United States Patent [19]

Lurie et al.

[11] Patent Number: 5,224,878

[45] Date of Patent: Jul. 6, 1993

[54] CONNECTOR FILTER WITH INTEGRAL SURGE PROTECTION

[75] Inventors: George R. Lurie; Ping Peng, both of Harrisburg, Pa.

[73] Assignee: AMP Incorporated, Harrisburg, Pa.

[21] Appl. No.: 860,948

[22] Filed: Mar. 31, 1992

[51] Int. Cl.[5] ..... H01R 13/66

[52] U.S. Cl. ..... 439/620

[58] Field of Search ..... 439/607, 620; 361/56

[56] References Cited

U.S. PATENT DOCUMENTS

| | | | |
|---|---|---|---|
| Re. 29,258 | 6/1977 | Fritz | 333/70 |
| 4,233,641 | 11/1980 | Baumbach | 361/119 |
| 4,547,831 | 10/1985 | Hellman et al. | 361/127 |
| 4,580,866 | 4/1986 | Hagner | 339/147 R |
| 4,660,907 | 4/1987 | Belter | 339/14 R |
| 4,726,638 | 2/1988 | Farrar et al. | 439/620 R |
| 4,729,743 | 3/1988 | Farrar et al. | 439/276 |
| 4,729,752 | 3/1988 | Dawson, Jr. et al. | 439/620 |
| 4,739,436 | 4/1988 | Stefani et al. | 361/56 |
| 4,772,225 | 9/1988 | Ulery | 439/620 |
| 4,792,310 | 12/1988 | Hori et al. | 439/620 |
| 4,797,120 | 1/1989 | Ulery | 439/578 |
| 4,804,332 | 2/1989 | Pirc | 439/620 |
| 4,809,124 | 2/1989 | Kresge | 361/58 |
| 4,845,452 | 7/1989 | Sasaki et al. | 336/200 |
| 4,853,670 | 8/1989 | Stengard | 338/21 |
| 4,901,183 | 2/1990 | Lee | 361/56 |
| 4,903,161 | 2/1990 | Huber et al. | 361/56 |
| 4,907,118 | 3/1990 | Hames | 361/56 |
| 4,908,730 | 3/1990 | Westrom | 361/120 |
| 4,930,200 | 6/1990 | Brush, Jr. et al. | 29/25.42 |
| 4,995,834 | 2/1991 | Hasagawa | 439/620 |
| 5,023,746 | 6/1991 | Epstein | 361/56 |
| 5,150,086 | 9/1992 | Ito | 333/182 |

OTHER PUBLICATIONS

EMI Bulletin "EMI Suppression Filter", MuRata Manufacturing Co. Ltd.

*Primary Examiner*—Eugene F. Desmond

*Attorney, Agent, or Firm*—Katherine A. Nelson; Anton P. Ness

[57] ABSTRACT

An electrical connector (10) and a filter insert (60) include a planar inductor (62) having recesses (63) containing MOV voltage surge protectors (72) fitted therein with conductive traces (68) formed on the surface of the inductor connecting signal pin portions (50) of contacts (44) that extend through the inductor to the protectors and ground traces (70) that connect the protectors to ground circuits provided by the shell portion (22), the inductor providing an L and the protector providing an internal C to form an LC network filtering out unwanted signal frequency components; the protector (72) operating to connect signal traces to a ground trace in the presence of excessive voltage transients. The insert (60) is dimensioned to fit interiorly of the connector (10). A multi-pin connector is contemplated with a common inductor plate (62) for such connector.

15 Claims, 4 Drawing Sheets

CONNECTOR FILTER WITH INTEGRAL SURGE PROTECTION

This invention relates to an electrical connector and filter insert providing signal filtering and voltage protection.

BACKGROUND OF INVENTION

The continuing use of electronic equipment has been attended by problems caused by electro magnetic interference (EMI) and electro static discharge (ESD); EMI resulting in interference with proper signal transfer and ESD destroying electronic components through excessive voltage. An answer to these problems has been generally one of providing filtering to filter out the unwanted frequency components represented by EMI and to provide voltage protection to preclude voltage spikes or surges from getting through to cause a circuit component damage. A widely used practice has been to place discrete filters on circuit boards selected to block those frequencies that may interfere with signals, particularly digital signals or the components and harmonics of such signals and to utilize voltage surge devices, additionally board mounted, to provide surge protection. U.S. Pat. No. 4,729,752 describes a connector having a built in signal transient suppressor that may be utilized with existing connectors to provide a compact solution to the problem and save expensive printed circuit board space. Signal voltage transient suppression is provided in a preferred embodiment by bi-directional diode, or diodes to provide protection for both positive and negative voltage surges. One embodiment of the device teaches the use of filtering means in the form of filter sleeves of a type illustrated in U.S. Pat. No. Re. No. 29,258 in combination with the transient protection; and both fitted within the housing of a multi-pin connector.

The foregoing solution to the problem of filtering unwanted components of signals and protecting against voltage surges involves the use of discrete filter and voltage protector components requiring an assembly entailing the individual handling of small electronic devices, multiple steps and soldering operations and while of considerable utility entail a cost limiting use to those applications where surge protection and filtering functions are more important than cost. As a result, numerous applications involving particularly consumer electronic devices, vehicular electronic circuits and the like have not been protected.

Accordingly, it is an object of the present invention to provide an improved, low cost filter/surge protector device that readily lends itself for assembly into connectors and the like.

It is a further object to provide an integrated filter/-surge protector that may be used with existing connectors as a retrofit or utilized in the ever increasing applications that require an economic solution to EMI and ESD phenomenon.

It is yet a further object to provide a connector insert that includes an LC network and voltage protection in an integral structure that can be manufactured as such, handled, installed into connectors to provide such functional protection.

It is a final object of the invention to provide a novel connector combination having built-in filtering and voltage protection.

SUMMARY OF THE INVENTION

The present invention achieves the foregoing objectives through the integration of an inductance L with a capacitance C provided by the internal capacitance of a metal oxide varistor (MOV). The invention contemplates the use of a ferrite plate having apertures therein compatible with the pins of a connector that can be inserted through such apertures allowing the plate to be affixed within the housing of a connector. The planar structure in the form of a ferrite plate becomes an insert that can be handled, installed and utilized with respect to either existing connectors or new connector designs. The plate is made to have recesses in the surface of one side disposed in a row or, in an alternating pattern, to receive discrete MOV devices that are inserted in such recesses and held therein. A thick film conductive trace is formed on such surface of the plate, suitably fired to provide a stable conductive path. The conductive path is made to extend from the apertures of the plate that carry the signal pins of the connector to the MOV device, one electrode thereof. The opposing electrode of the MOV device is jointed to a further thick film on the surface that goes to ground, with both electrodes soldered to such film and with the other path soldered to the pins. The internal capacitance of MOV devices is made sufficient to provide the capacitance C for an LC network filter. MOV devices are available in a range of voltage activation levels and ferrite plates are available having a variety of inductive effects on signals passed therethrough. The combination of the MOV device with the ferrite plate allows the forming of an insert that serves both the filtering and voltage surge protection function as well as allowing for a ready manufacture of the LC network/voltage protector apart of the invention in a form that can be readily incorporated into multi-pin signal paths.

DETAIL DESCRIPTION OF THE INVENTION

Figure 1:
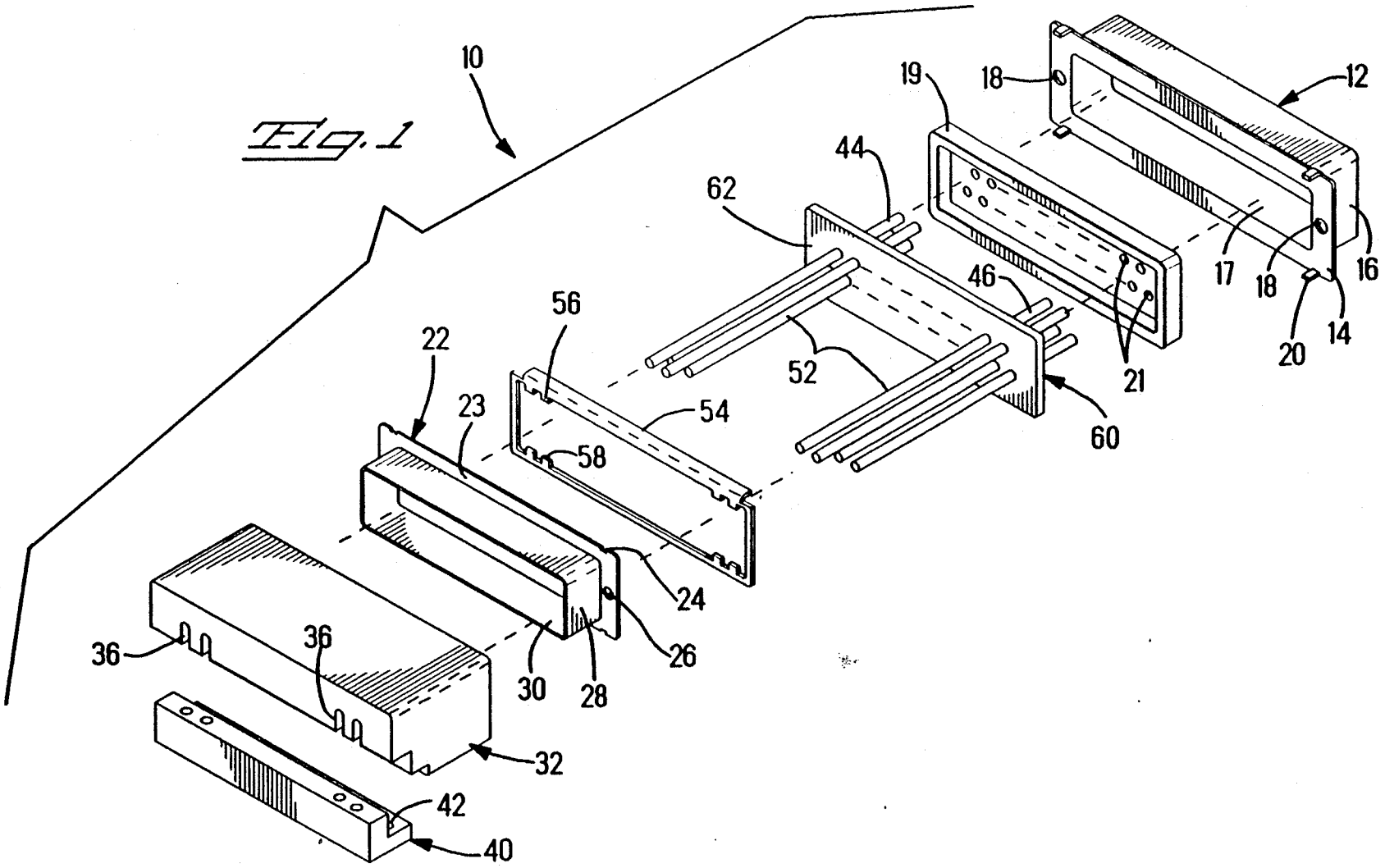
FIG. 1 is a perspective view of the elements of the connector of the invention shown exploded prior to assembly.
Figure 2:
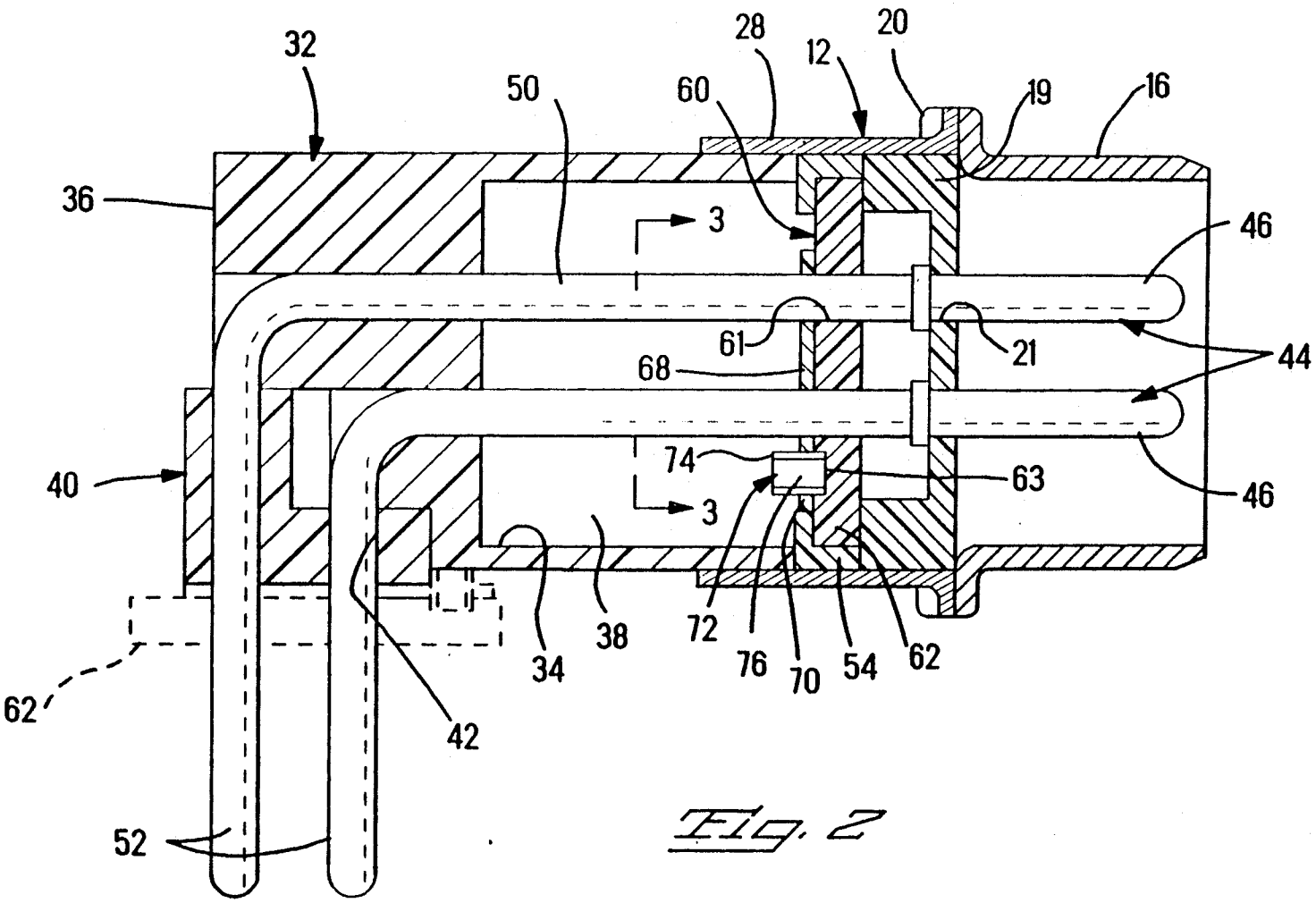
FIG. 2 is a side, elevational and partially sectioned view of the element shown in FIG. 1 as assembled.

Referring now to FIG. 1, an electrical connector 10 is shown to include a number of elements prior to assembly. To the right in the figure is a metal shell 12 having a flange 14 with a box like projecting portion 16 defining an interior cavity 17. Flange 14 includes apertures 18 adapted to receive fasteners that hold the assembly together and allow mounting of the assembly on a panel, facade or the like. Flange 14 further includes projections 20 at the top and the bottom and outside corners that facilitate locking the various elements together. Also shown is a further shell 22 having a flange 23 having notches 24 top and bottom adapted to receive the projections 20 with the projections 20 being crimped around the notches in the manner shown in FIG. 2 to lock the two shell halves 12 and 22 together. Apertures 26 compliment the apertures 18 and facilitate mounting of the connector. The shell 22 includes a projection 28 defining recess 30 that receives a plastic housing comprised of a block 32 and a block 40. The block 32 includes a series of apertures 36 that facilitate insertion of the contacts and an interior recess 38 as shown in FIG. 2. Block 40 includes apertures 42 that receive pin portions of contacts and align such for insertion in a printed circuit board, note the disposition of the pin portions 52 of contacts 44 shown in FIG. 2.

As can be seen in FIG. 1 and in FIG. 2, an insert 19 is included having apertures 21 that receive portions 50 of the contacts 44 inserted therethrough. Insert 19 is preferably made of a plastic material similar to that of blocks 32 and 40. A metallic frame 54 is provided having a geometry as shown in FIGS. 1 and 2, including flanges of 56 and 58 that extend downwardly from the outside edges of the frame. Next in the assembly, is connector insert 60 that provides the filtering and surge protection function to the signal paths defined by contacts 44 made to extend through the insert and be secured thereto.

Figure 3:
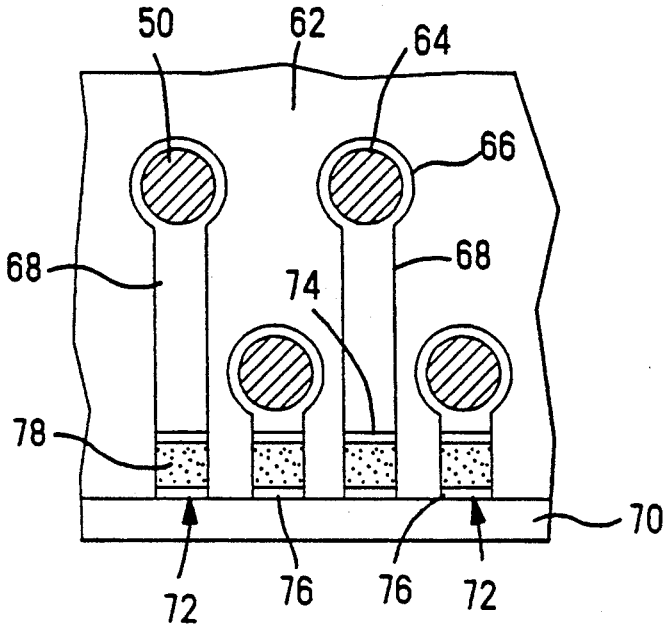
FIG. 3 is an elevational view taken from the perspective of lines 3—3 in FIG. 2 showing an area of the insert of the invention.

As can be seen in FIG. 2, insert 60 includes a plate 62 made of ferrite material to provide an inductance for the signal paths. Plate 62 is made to include a series of slots or recesses 63 that extend across the plate, one for each signal path in the manner shown in FIG. 3. Plate 62 also includes a series of apertures 64 adapted to receive pin portions 50 of contacts 44. On one surface of the plate 62 are conductive traces having a configuration as shown in FIG. 3 to include a portion 66 surrounding aperture 64 and pin portion 50. Trace portion 66 joins further trace 68 that leads to a component-receiving region, and is shown to extend to a recess 63. A ground trace 70 is also provided on the same surface and extends to a peripheral portion of ferrite plate 62 to be exposed for grounding, such as having an edge adjacent the recesses 63. Circuit-modifying components such as MOV devices are affixed to ferrite plate 62 n the component-receiving region in electrical connection with respective pins 50 and connected to ground upon full connector assembly. As shown, an MOV device 72 is positioned in each recess, each MOV device 72 includes electrode surfaces 74 and 76 just adjacent edge surfaces of the traces 68 and 70. The device 72 further includes the metal oxide body of 78. The trace portions 66,68,70 are soldered to the signal paths, pins 50 and the electrodes 74 and 76 in the manner shown in FIG. 2. This serves to provide a path from each pin 50 through an MOV device to ground, the trace 70 being made to contact frame 54, the frame being grounded to the shell 22 and in turn through appropriate grounding circuits to a printed circuit board and a mating connector half that mates with the connector half shown in FIG. 2.

The connector shown in FIG. 2 is positioned on a printed circuit board, not shown, with the pin portions 52 inserted through holes therein and soldered thereto to establish a signal path through the connector to the board and return. Contacts 44 to have rounded post portions 46 extending within the shell structure 16 that mate with receptacle contacts of a mating half connector not shown. Flanges extending outwardly from contacts 44 serve to anchor the contacts against displacement in one direction. Clinched projections 20 and soldering of contact portions 50 to plate 62, in conjunction with frame 54, lock the assembly against pin displacement inwardly of the connector. In practice the connector insert 60 may be manufactured with the contacts 34 added in the straight configuration shown in FIG. 1, and of appropriate length. During assembly pin portions 50 are inserted through the housing block 32, apertures 38 and then deformed, bent at right angles from the configuration shown FIG. 1 to the configuration shown in FIG. 2 and the block 40 added thereafter and positioned up against block 32 in the manner shown in FIG. 2.

Alternatively, insert 62 may be positioned under the connector as shown in phantom in FIG. 2, instead of inside the connector housing. The insert 62 would be adjacent to the circuit board with the circuit traces 66,68 soldered to the signal paths and the ground trace connected to a board ground or an extended ground shell of the connector. Other uses for insert 60 to accommodate multiple circuit devices are also contemplated.

Figure 4:
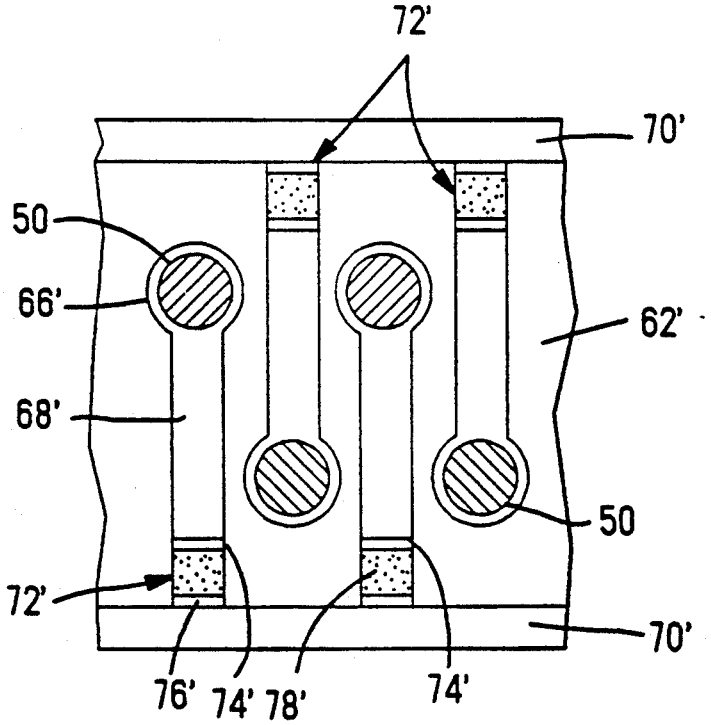
FIG. 4 is a view similar of FIG. 3 but showing an alternative embodiment of the insert of the invention.

An alternative embodiment of the insert 60 is shown in FIG. 4 to include a block 62' having traces 66', 68' and 70' with the trace 70' positioned top and bottom of the block 62'. In this embodiment, the recesses in block 62' are arranged top and bottom with the electrodes 74' and 76' positioned to engage the signal traces 68' and grounded traces 70', respectively. As in the previous embodiment the various pin portions 50 extend through apertures 64' and are soldered to the trace portion 66' and the electrodes of the MOV device are soldered to the traces 68' and 70'. To be noted, with respect to the embodiment of FIG. 4 is the physical length of the traces 68', such trace lengths being constant in the embodiment of FIG. 4 verses the variation in length with respect to the embodiment shown in FIG. 3. The alternative embodiments are described and can be used with the different types of geometries where size and restrictions favor an alternative disposition of MOV devices.

Figure 5:
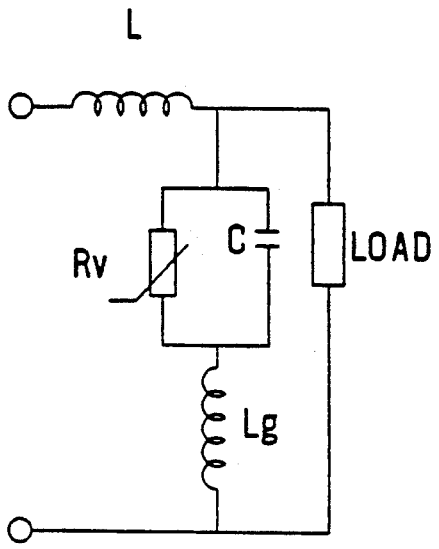
FIG. 5 is an equivalent circuit representation of the filter/surge protector of the invention.

FIG. 5 shows an equivalent circuit diagram wherein the signal path for a given contact has an inductance L that represents that portion of the ferrite plate 62 affecting the signal passing through a contact to load, load representing the circuit to which the contact is connected. In FIG. 5, Rv presents the variable resistance of the metallic oxide of the MOV with C representing the internal capacitance of the such device. The inductance Lg represents the ground inductance caused by the traces including trace portion 68 and 68'. It has been discovered that the internal capacitance C of readily available MOV devices is sufficient to form in conjunction with L, an LC network capable of providing substantial filtering of unwanted signals transmitted by the contacts 44.

Figure 6:
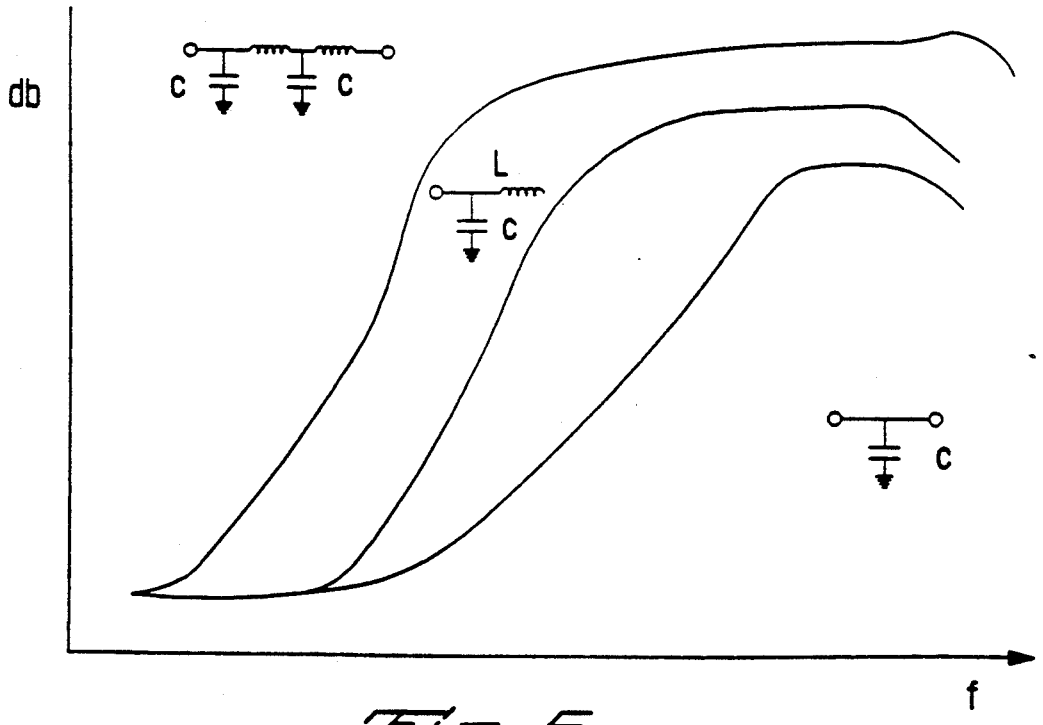
FIG. 6 is a schematic graph representation showing a attenuation verses frequency characteristics for three types of filter circuits.

FIG. 6 shows an attenuation measured in db verses frequency for different types of filtering circuits. A single capacitance filter shown to the right in FIG. 6 is associated with a characteristic response that shows a relatively slow rise in the attenuation as frequency increases. The characteristic curve shown in FIG. 6 relative to an LC network shows an improved attenuation at the lower frequencies, afforded by the addition of L in the circuit. A still improved performance in the lower frequencies in terms of attenuation is shown through the representation of a Pi filter network having an extra L therein the addition of sections C and L serving into provide more attenuation at the lower frequencies. The invention facilitates an improvement as shown in FIG. 6 over purely capacitive devices through the addition of inductance L preferably of high permeability material. To be appreciated further is the reliability of commercially available MOV devices that can withstand very substantial voltage levels, of the automobile ignition pulses, for example.

Also to be appreciated is the size of commercially available multilayer MOV chips that can have dimensions as small as 0.040 by 0.040 inches in a surface mount version. This small size allows the MOV device to be used in a wide range of commercially available connectors. The concept of utilizing an insert made to fit given connectors and dimensioned to fit within the existing configuration of connectors further allows a cost advantage and extends uses of the invention.

In a working prototype of the invention the ferrite block 62 was made of a material #29 manufactured by Steward Manufacturing Company. It had an IR greater than one giga ohm, and initial permeability on the order of 400, Curie temperature on the order greater, or equal to 175° C. The thick film conductive traces was a Hereus-Cermalloy thick film ink, Pd-Ag, C-4740HK material, fired at 850° C. for eight minutes at peak temperature in a standard 40-45 minute firing cycle.

Different MOV devices in the form of chips were employed including those from the Harris Company or AVX. These chips had clamping voltages on the order of from 12 to 120 volts, a choice for a given part and working voltages on the order of 3.5 to 68 volts. The chips were able to handle on the order of 0.3 to 4.0 Joules, non-repetitive surge energy at current levels on the order of from 145 to 300 amps and a non-repetitive surge current on the order of 20 microseconds in duration. The chips were found functional from −55 to +125 degrees C.

Utilizing the Harris Company device, V26MLA1206, an attenuation peaking at just under 40 dB insertion loss was attained at frequencies between 60 and 90 megahertz in a circuit like that here disclosed of the alternative version shown in phantom in FIG. 2. The discovery that the internal capacitance C of MOV devices can become effective in LC network filters opens a wide range of applications and extends the potential for effective filtering and surge protection in terms of cost and space relative to performance in a wide range of connector geometries.

The invention also contemplates other applications where the disposition of signal and ground paths facilitates the use of inductors and MOV devices to form filter/surge protectors.

While the invention has been described relative to specific preferred embodiments it is to be understood that different types of MOV devices and different types of inductors, different shapes of ferrite elements including discrete ferrite blocks having recesses receiving the MOV device, as well as additional capacity or inductive elements maybe employed.

Having now defined the invention, in terms intended to enable a preferred practice thereof, we now define the invention through the appended claims:

We claim:

1. In combination, a filter-surge protector including at least one signal conductor and ground path for grounding unwanted signal frequency and voltage components, a ferrite structure having portions surrounding each said signal conductor to provide an inductance L to a signal therealong, an MOV device mounted to said ferrite structure and connected between each said signal conductor and said ground path having characteristics to ground a respective signal along said signal conductor containing voltage components of above a desired level and having an internal capacitance C operable to form with the inductance L an LC network to filter unwanted frequency components from said signal.

2. The filter/surge protector of claim 1, wherein said ferrite structure has conductive traces on the surface thereof defining said ground paths and defining signal paths extending between and electrically connecting said signal conductors to respective said MOV devices.

3. The filter/surge protector of claim 1, wherein said inductor is comprised of a ferrite structure having recesses therein with said MOV devices fitted in respective said recesses.

4. The filter/surge protector of claim 1 including a plurality of contacts having pin portions arranged in at least a row and said inductor is a ferrite plate apertured to receive respective said pin portions inserted therethrough with said ferrite plate further including conductive traces on the surface thereof defining said ground paths and defining signal paths extending between and electrically connecting said pin portions to respective said MOV devices.

5. A filter/surge protector insert adapted to be used with an electrical connector of a type having an insulating housing and a surrounding shielding and grounding shell fitted over such housing with contact pins held by said housing within said shell in at least a row to define signal paths with the said shell defining the grounding paths relative thereto, the said insert including a ferrite plate of a dimension to fit within the said connector, said plate having apertures and contacts contained within said apertures, said plate further having a series of recesses in a surface thereof and an MOV device in each recess including first and second electrodes mounted in a sense perpendicular to said surface, said plate including conductive traces extending on the said surface adjoining a given contact to a first electrode of the MOV device to define a signal trace and including a further trace connected to the second electrode of the MOV device to define a ground trace with the said ground trace being adapted to be connected to the shielding and grounding shell of the connector, the ferrite plate having an inductance L and the MOV device having an internal capacitance C to form an LC network to filter unwanted frequency signal components carried by said contacts and having a voltage response adapted to connect said signal trace to said ground trace in the presence of excessive voltages.

6. An electrical connector adapted to carry signals including a plastic housing, a plurality of contacts mounted in said housing having portions adapted to mate with the contacts of a further connector and including pin portions adapted to connect to circuits of a circuit board, a shielding and grounding shell surrounding portions of said housing and an insert for said connector including an inductor plate of an inductance L apertured to receive the pin portions of said contacts inserted therethrough, an MOV device for each said contact mounted on said plate and having a pair of electrodes, a first conductive trace carried on a surface of said plate extending from a said pin portion of an associated said contact to one of the electrodes of said MOV device to define a signal trace, a further trace on the said surface connecting the other electrode of said MOV device to define a ground circuit with said ground circuit connected to said shell, said plate including an inductance L for said pin portion of each said contact, each MOV device including an internal capacitance C to form with L an LC network to attenuate unwanted frequency components from signals transmitted along said contacts of the connector and each said MOV device having voltage breakdown characteristics to connect said contacts to said ground path in the presence of unwanted voltage transients to provide a filter/surge protection for the connector.

7. The connector of claim 6 wherein said inductor plate is common to all said pin portions and all said contacts.

8. The connector of claim 7 wherein said plate includes recesses with a said MOV device inserted in each said recess and with the electrodes of the MOV device connected separately to the ground and signal traces.

9. The connector of claim 7 wherein the said shell includes an interior volume with said plate having dimensions to fit within said volume and reside within the profile of said connector.

10. The connector of claim 7 wherein said plate includes recesses along one side surface thereof containing said MOV devices.

11. The connector of claim 7 wherein said plate includes recesses in rows on two side surfaces thereof containing said MOV devices.

12. The connector of claim 7 wherein the signal traces are of essentially constant length to provide a constant grounding inductance for each signal path.

13. A circuit-modifying insert adapted to be used with an electrical connector of a type having an insulating housing and a surrounding shielding and grounding shell fitted over such housing with contact pins held by said housing within said shell, said insert including a ferrite plate of a dimension to fit within said connector, said plate having apertures adapted to receive therethrough pin portions of respective said contact pins, said plate further including first conductive traces extending from respective said apertures to a component-receiving region of said plate and second conductive traces extending from said component-receiving region to a peripheral edge of said plate exposed for electrical connection to said shell upon connector assembly, and said plate further having an array of circuit-modifying components secured thereto in said component-receiving region with first electrodes electrically joined to said first conductive traces and second electrodes electrically joined to said second conductive traces.

14. The circuit-modifying insert of claim 13, wherein said component-receiving region of said plate includes recesses extending between ends of respective said first conductive traces and associated second conductive traces, said recesses containing therein portions of respective said circuit-modifying components.

15. The circuit-modifying insert of claim 13, wherein said circuit-modifying components are MOV devices.

* * * * *